US006213196B1

(12) United States Patent
Ozaki et al.

(10) Patent No.: US 6,213,196 B1
(45) Date of Patent: Apr. 10, 2001

(54) DOUBLE HEAT EXCHANGER FOR VEHICLE AIR CONDITIONER

(75) Inventors: Tatsuo Ozaki, Okazaki; Takaaki Sakane; Kenichi Kachi, both of Nagoya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/640,228

(22) Filed: Aug. 16, 2000

(30) Foreign Application Priority Data

Sep. 29, 1999 (JP) ..... 11-276941

(51) Int. Cl.[7] ..... F28F 13/00
(52) U.S. Cl. ..... 165/140; 165/135
(58) Field of Search ..... 165/140, 135, 165/144

(56) References Cited

U.S. PATENT DOCUMENTS 5,172,752 * 12/1992 Goetz, Jr. ..... 165/140 X
5,992,514 * 11/1999 Sugimoto et al. ..... 165/135

FOREIGN PATENT DOCUMENTS 11-148795 6/1999 (JP) .

* cited by examiner

*Primary Examiner*—Leonard Leo
(74) *Attorney, Agent, or Firm*—Harness, Dickey & Pierce, PLC

(57) ABSTRACT

A double heat exchanger for a vehicle air conditioner combining a condenser and a radiator has a corrugated condenser fin and a corrugated radiator fin integrally formed and having the same fin pitch. Each of the condenser and radiator fins has plural upper folds, plural lower folds and plural wall portions each of which connects one of the upper folds and one of the lower folds next to each other. An inclination angle of each of the wall portions of the condenser fin is made different from that of each of the wall portions of the radiator fin. As a result, a height of the condenser fin becomes different from that of the radiator fin while maintaining a radius of curvature of each of the upper and lower folds of the condenser fin equal to that of each of the upper and lower folds of the radiator fin.

14 Claims, 4 Drawing Sheets

DOUBLE HEAT EXCHANGER FOR VEHICLE AIR CONDITIONER

CROSS REFERENCE TO RELATED APPLICATIONS

This application relates to and claims priority from Japanese Patent Application No. 11-276941 filed on Sep. 29, 1999, the contents of which are hereby incorporated by reference.

BACKGROUND OF THE INVENTION

1. Field of the Invention

The present invention relates generally to heat exchangers, and particularly to a double heat exchanger having plural heat exchange cores. The present invention is suitably applied to a double heat exchanger combining a condenser of a refrigeration cycle for a vehicle air conditioner and a radiator for cooling engine coolant.

2. Related Art

Generally, in a double heat exchanger having plural heat exchange cores, a specification of one of the heat exchange cores does not necessarily conform to a specification of the other. Conventionally, a double heat exchanger has a condenser core and a radiator core in which a corrugated condenser fin and a corrugated radiator fin are integrally formed. In such a heat exchanger, when plural condenser tubes and plural radiator tubes are arranged in a vertical direction at the same pitch and a height of each of the radiator tubes is larger than that of each of the condenser tubes in the vertical direction, a height of the condenser fin disposed between adjacent condenser tubes needs to be larger than that of the radiator fin disposed between adjacent radiator tubes in the vertical direction.

However, since the condenser fin is integrally formed with the radiator fin, a longitudinal length of the condenser fin when flattened to a flat plate is necessarily equal to that of the radiator fin. Therefore, a height of the condenser fin can not be simply increased by increasing only the longitudinal length of the condenser fin.

JP-A-11-148795 discloses a double heat exchanger in which a height of a corrugated radiator fin is made larger than that of a corrugated condenser fin by setting a radius of curvature of each wave of the radiator fin smaller than that of each wave of the condenser fin. However, generally, in a multi-flow type heat exchanger having plural tubes, the tubes and plural fins are alternately layered to be tentatively assembled and then integrally brazed in a furnace. Therefore, when a radius of curvature of each wave of the condenser fin is different from that of the radiator fin, an amount of deformation of the condenser fin caused by a force of constraint applied to the condenser fin during an assembling process of the condenser fin and condenser tubes becomes different from that of the radiator fin, even if the condenser fin and the radiator fin are made of the same material and has the same plate thickness. As a result, a contact pressure between the condenser fin and each of the condenser tubes may be largely different from a contact pressure between the radiator fin and each of radiator tubes, thereby causing a fin-tube brazing failure.

Further, when a radius of curvature of each wave of the fin is decreased, a filler is restricted from being formed at a connection portion between the fin and the tube during brazing. Therefore, an area of heat transfer from the tube to the fin is decreased, thereby declining heat exchange performance of the heat exchanger.

SUMMARY OF THE INVENTION

In view of the foregoing problems, it is an object of the present invention to provide a heat exchanger having first and second heat exchangers, in which a first corrugated fin of the first heat exchanger is integrally formed with a second corrugated fin of the second heat exchanger while a radius of curvature of each wave of the first fin is not largely different from that of the second fin.

According to the present invention, a heat exchanger has a first heat exchanger and a second heat exchanger disposed at a downstream air side of the first heat exchanger. The first heat exchanger has a plurality of first tubes through which a first fluid flows and a first fin disposed between adjacent first tubes to facilitate heat exchange between the first fluid and air. The first fin has a corrugated shape including a plurality of first upper folds, a plurality of first lower folds and a first wall portion which connects one of the first upper folds and one of the first lower folds next to each other. The second heat exchanger has a plurality of second tubes through which a second fluid flows and a second fin disposed between adjacent second tubes to facilitate heat exchange between the second fluid and air. The second tubes extend in substantially parallel with the first tubes. The second fin is integrally formed with the first fin to have a corrugated shape including a plurality of second upper folds, a plurality of second lower folds and a second wall portion which connects one of the second upper folds and one of the second lower folds next to each other. The first and second fins are partially connected to each other through a connection member. An inclination angle of the first wall portion is different from that of the second wall portion so that a height of the first fin becomes different from that of the second fin.

Therefore, a height of the first fin becomes different from that of the second fin while maintaining a radius of curvature of each of the first upper and lower folds of the first fin equal to that of each of the second upper and lower folds of the second fin. As a result, the first fin and the second fin respectively make contact with each of the first tubes and the second tubes with the substantially same contact pressure during an assembling process, thereby restricting a brazing failure between the first and second fins and each of the first and second tubes. Further, according to the present invention, each of the radius of curvature of the first and second fins becomes a relatively large value. Therefore, a fillet is sufficiently formed between the first and second fins and each of the first and second tubes, respectively, during a brazing process, and a heat exchange performance of the heat exchanger is restricted from declining.

BRIEF DESCRIPTION OF THE DRAWINGS

This and other objects and features of the present invention will become more readily apparent from a better understanding of the preferred embodiment described below with reference to the accompanying drawings, in which.

DETAILED DESCRIPTION OF THE PREFERRED EMBODIMENT

Figure 1:
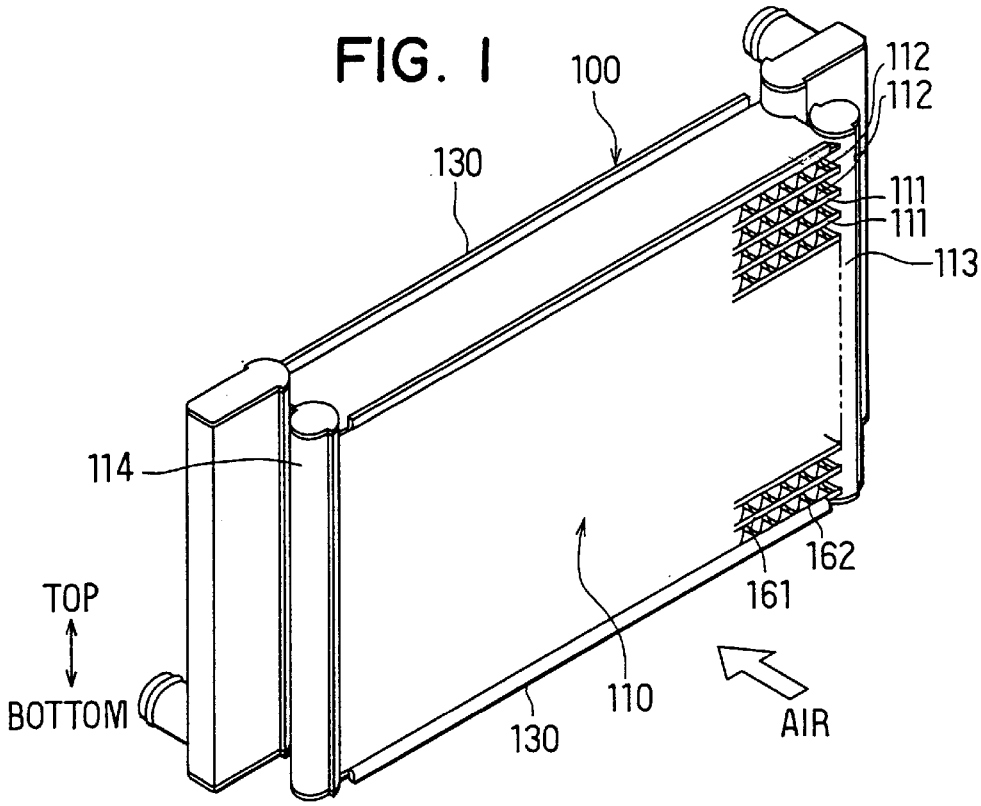
FIG. 1 is a schematic perspective view showing a double heat exchanger according to a preferred embodiment of the present invention.
Figure 2:
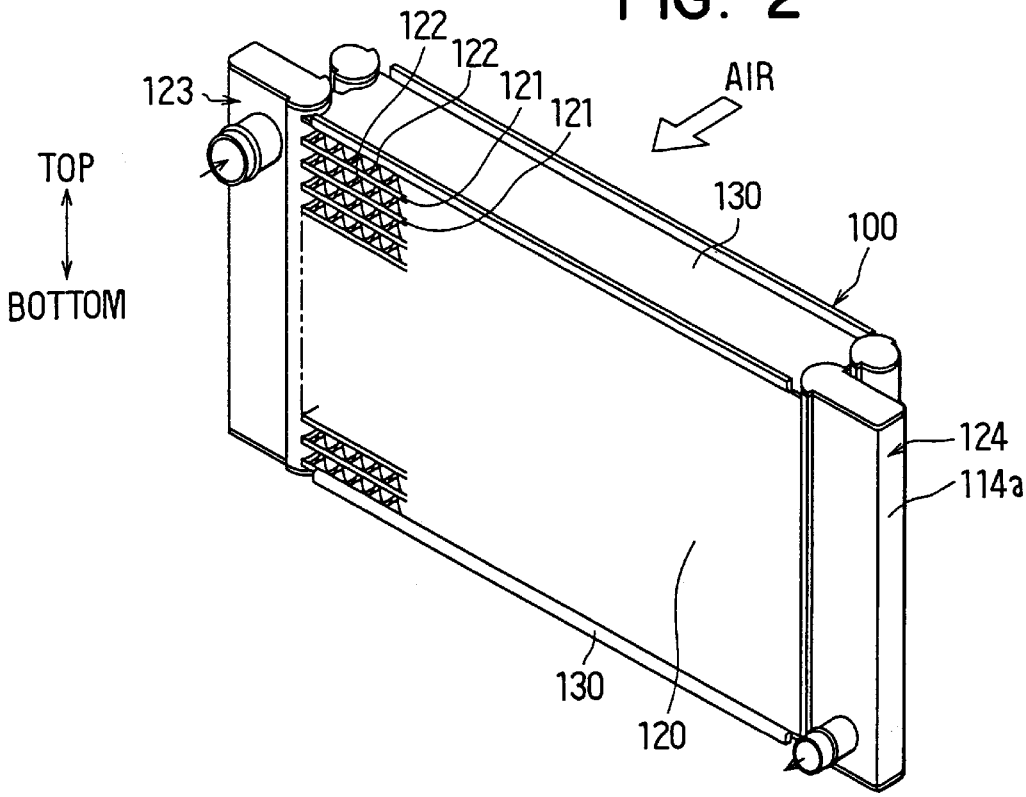
FIG. 2 is a schematic perspective view showing the double heat exchanger according to the embodiment.

A preferred embodiment of the present invention is described hereinafter with reference to the accompanying drawings. In the embodiment, the present invention is applied to a double heat exchanger 100 having a condenser 110 of a refrigeration cycle for a vehicle air conditioner and a radiator 120 for cooling engine coolant which cools a water-cooled engine of a vehicle. In FIG. 1, the double heat exchanger 100 is viewed from an upstream air side with respect to air passing therethrough. In FIG. 2, the double heat exchanger 100 is viewed from a downstream air side, that is, from the engine.

As shown in FIG. 1, the double heat exchanger 100 has the condenser 110 which performs heat exchange between refrigerant circulating the refrigeration cycle and air passing through the condenser 110 so that refrigerant is cooled. The condenser 110 has plural condenser tubes 111 through which refrigerant flows, plural condenser fins 112 each of which is disposed between adjacent condenser tubes 111 to facilitate heat exchange between refrigerant and air and header tanks 113, 114 respectively disposed at right and left flow-path ends of the condenser tubes 111 in FIG. 1 to communicate with the condenser tubes 111. Refrigerant in the header tank 113 is distributed into each of the condenser tubes 111. After being heat-exchanged with air, refrigerant flowing through each of the condenser tubes 111 is collected into the header tank 114.

Figure 3:
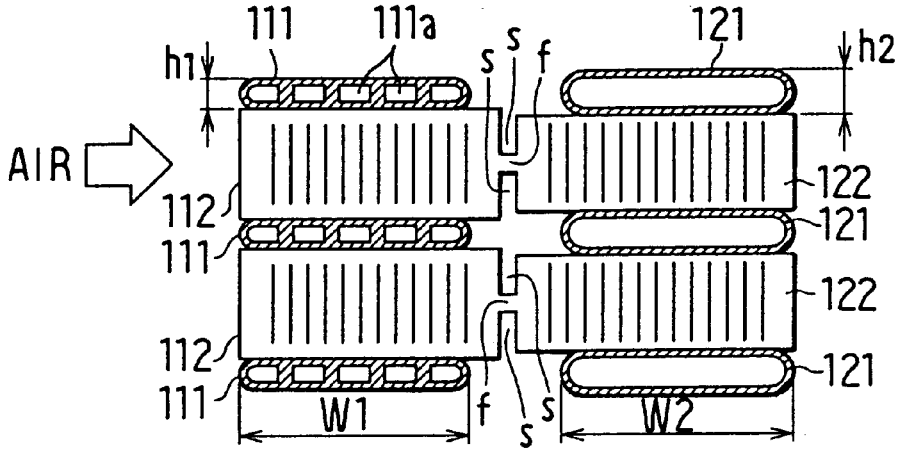
FIG. 3 is a partial sectional view showing the double heat exchanger according to the embodiment.

As shown in FIG. 3, each of the condenser tubes 111 is formed into a flat shape by extrusion or drawing and has plural refrigerant passages 111*a* extending in a longitudinal direction of the condenser tubes 111 therein. Each of the condenser fins 112 is integrally formed with each of radiator fins 122 of the radiator 120.

As shown in FIG. 2, the double heat exchanger 100 has the radiator 120 which performs heat exchange between engine coolant discharged from the engine and air passing through the radiator 120 so that engine coolant is cooled. The radiator 120 has plural radiator tubes 121 through which engine coolant flows, plural radiator fins 122 each of which is disposed between adjacent radiator tubes 121 to facilitate heat exchange between engine coolant and air and header tanks 123, 124 respectively disposed at left and right flow-path ends of the radiator tubes 121 in FIG. 2 to communicate with the radiator tubes 121. Engine coolant flowing into the header tank 123 is distributed into each of the radiator tubes 121. After being heat-exchanged with air, engine coolant flowing through each of the radiator tubes 121 is collected into the header tank 124.

As shown in FIG. 3, each of the radiator tubes 121 is formed into a flat shape. A height h2 of each of the radiator tubes 121 in a longitudinal direction of the header tanks 113, 114, 123 and 124 is larger than a height h1 of each of the condenser tubes 111. Preferably, h1 is set to 0.8–1.4 mm, and h2 is set to 1.0–1.6 mm. A width W1 of each of the condenser tubes 111 in a direction in which air passes through the double heat exchanger 100 is substantially equal to a width W2 of each of the radiator tubes 121. Refrigerant flows through the condenser tubes 111 while changing from gas refrigerant to liquid refrigerant. Engine coolant flows through the radiator tubes 121 without phase change. Therefore, a cross-sectional area of flow of each of the radiator tubes 121 is preferably set larger than that of each of the condenser tubes 111.

Further, as shown in FIGS. 1 and 2, a pair of side plates 130 are respectively disposed at upper and lower ends of the condenser 110 and the radiator 120 for reinforcing the condenser 110 and the radiator 120. The tubes 111, 121, the fins 112, 122, the header tanks 113, 114, 123, 124 and the side plates 130 are integrally brazed.

Figure 4:
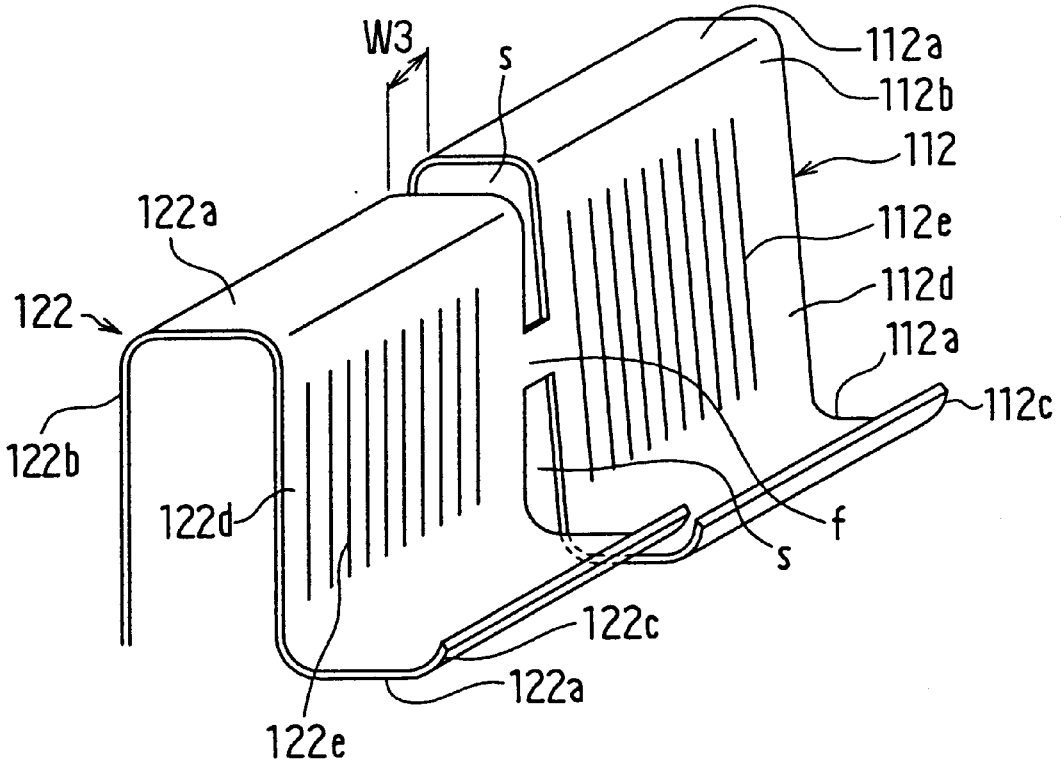
FIG. 4 is a schematic partial perspective view showing a fin of the double heat exchanger according to the embodiment.
Figure 5:
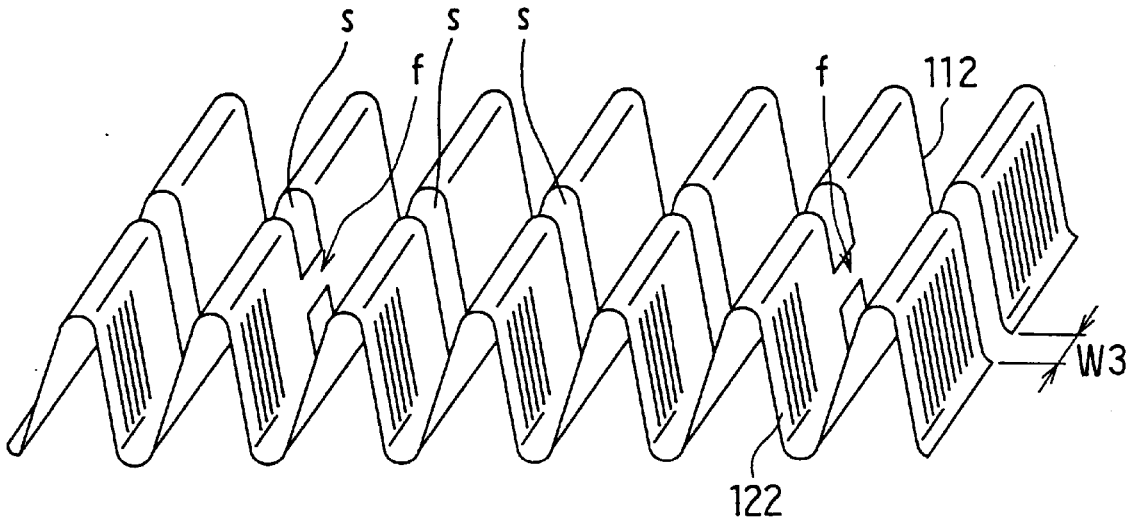
FIG. 5 is a schematic partial perspective view showing the fin according to the embodiment.

Next, the condenser and radiator fins 112, 122 are described in detail with reference to FIGS. 3–6. As shown in FIGS. 3–6, the condenser fin 112 and the radiator fin 122 are integrally formed by rolling. As shown in FIGS. 4 and 5, the condenser fin 112 is bent into a corrugated shape having plural upper folds 112*b* and plural lower folds 112*c*. Each of the upper folds 112*b* and the lower folds 112*c* is formed into a rectangular wave shape to have a flat portion 112*a* extending in substantially parallel with a longitudinal direction of the condenser and radiator tubes 111, 121. Further, the condenser fin 112 has plural wall portions 112*d* each of which connects one of the upper folds 112*b* and one of the lower folds 112*c* disposed next to each other. Similarly, the radiator fin 122 is bent into a corrugated shape having plural upper folds 122*b*, plural lower folds 122*c*, plural flat portions 122*a* and plural wall portions 122*d*.

Figure 6:
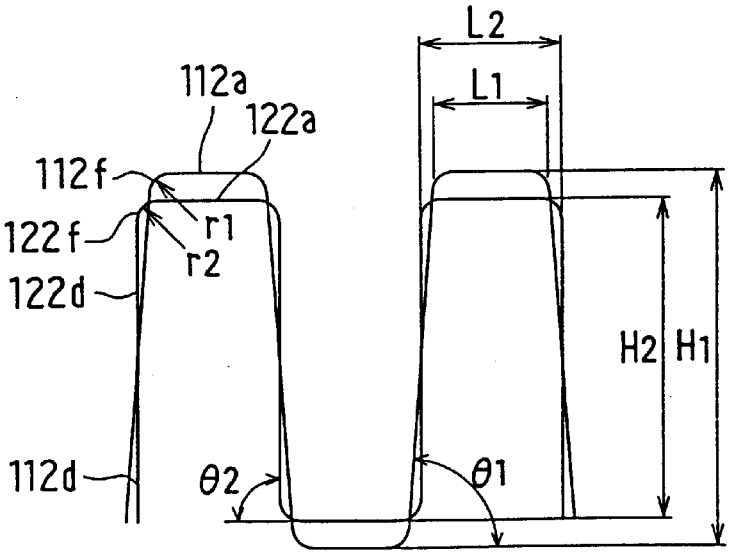
FIG. 6 is a schematic partial front view showing the fin according to the embodiment.

Each of the wall portions 112*d*, 122*d* has plural louvers 112*e*, 122*e* each of which is formed by cutting and raising a part of the wall portions 112*d*, 122*d*, respectively. The louvers 112*e*, 122*e* disturb a flow of air passing by the condenser and radiator fins 112, 122 and restrict a temperature boundary layer from growing. Further, as shown in FIGS. 4 and 5, plural connection portions f are formed to partially connect the condenser fin 112 and the radiator fin 122 while creating a predetermined gap W3 therebetween. The connection portions f are disposed at intervals of several upper folds 112*b*, 122*b*. As shown in FIG. 6, an inclination angle θ1 of each of the wall portions 112*d* is made different from an inclination angle θ2 of each of the wall portions 122*d*.

The gap W3 is set to a value larger than a plate thickness of the condenser fin 112 and the radiator fin 122 and is set so that each of the connection portions f is distorted to absorb a difference between an inclination angle θ1 and an inclination angle θ2. Further, as shown in FIGS. 4 and 5, plural slits s are formed between the condenser fin 112 and the radiator fin 122 due to the gap W3. Heat transfer from the radiator 120 to the condenser 110 is restricted by the slits s.

According to the embodiment, an inclination angle θ1 of the condenser fin 112 is made different from an inclination angle θ2 of the radiator fin 122. The condenser fin 112 and the radiator fin 122 have the same fin pitch so that a distance between adjacent upper folds 112*b* is equal to a distance between adjacent upper folds 122*b*, and a longitudinal length of the condenser fin 112 when flattened is equal to that of the radiator fin 122. As a result, as shown in FIG. 6, a length L1 of each of the flat portions 112*a* of the condenser fin 112 becomes smaller than a length L2 of each of the flat portions 122*a* of the radiator fin 122 in a longitudinal direction of the condenser and radiator tubes 111, 121. L1 and L2 are dimensions of portions of each of the condenser and radiator fins 112, 122 extending in parallel with a longitudinal direction of the tubes 111, 121, respectively.

Further, a height H1 of the condenser fin 112, that is, a height difference between an upper end of each of the upper folds 112*b* and a lower end of each of the lower folds 112*c*, becomes larger than a height H2 of the radiator fin 122.

Therefore, the height H1 of the condenser fin 112 is made different from the height H2 of the radiator fin 122 while maintaining a radius of curvature r1 of a connection portion 112*f* of the condenser fin 112 equal to a radius of curvature r2 of a connection portion 122*f* of the radiator fin 122. The connection portion 112*f* is disposed between one of the upper folds 112*b* and one of the wall portions 112*d* disposed next to each other or between one of the lower folds 112*c* and one of the wall portions 112*d* disposed next to each other. The connection portion 122*f* is disposed between one of the upper folds 122*b* and one of the wall portions 122*d* disposed next to each other or between one of the lower folds 122*c* and one of the wall portions 122*d* disposed next to each other. As a result, when the double heat exchanger 100 is tentatively assembled, a contact pressure between the condenser fin 112 and each of the condenser tubes 111 is made equal to a contact pressure between the radiator fin 122 and each of the radiator tubes 121. Therefore, brazing failure between the condenser fin 112 and each of the condenser tubes 111 or between the radiator fin 122 and each of the radiator tubes 121 is restricted. Preferably, a difference ΔH between H1 and H2 is set to 0.1–1.0 mm, and a difference ΔL between L1 and L2 is set to 0.05–0.5 mm so that the condenser and radiator fins 112, 122 makes contact with each of the condenser and radiator tubes 111, 121 by a sufficiently large contact area, respectively.

Further, according to the embodiment, each of a radius of curvature r1 of the condenser fin 112 and a radius of curvature r2 of the radiator fin 122 is set to a relatively large value. As a result, a fillet is sufficiently formed at a connection portion between each of the condenser tubes 111 and the condenser fin 112 and a connection portion between each of the radiator tubes 121 and the radiator fin 122. Therefore, heat exchange performance of the double heat exchanger 100 is restricted from declining.

Moreover, as shown in FIG. 6, since the inclination angle θ1 of the condenser fin 112 is made different from the inclination angle θ2 of the radiator fin 122, each of the wall portions 112*d* of the condenser fin 112 is shifted from each of the wall portions 122*d* of the radiator fin 122 when viewed from an upstream air side. Therefore, a temperature boundary layer generated at an end portion of each of the wall portions 112*d* disposed at an upstream air side of each of the wall portions 122*d* is disturbed by each of the wall portions 122*d*. As a result, the temperature boundary layer is restricted from growing, and a heat transfer rate between air and refrigerant or air and engine coolant is improved.

Each of the condenser fin 112 and the radiator fin 122 may be formed into a corrugated shape having plural sine-wave folds, instead of the rectangular-wave folds. In such a case, the flat portions 112*a*, 122*a* are not formed, and each of the upper folds 112*b*, 122*b* and the lower folds 112*c*, 122*c* has a uniform radius of curvature. Further, each of the slits s may be formed into a linear shape by cutting in a line between the condenser fin 112 and the radiator fin 122 so that an extremely small gap is formed between the condenser fin 112 and the radiator fin 122. In such a case, the connection portions f need to be formed at intervals of several upper folds 112*b*, 122*b* to make the inclination angle θ1 different from the inclination angle θ2. However, when the slits S are formed to secure the predetermined gap W3 between the condenser fin 112 and the radiator fin 122 as shown in FIGS. 4 and 5, the connection portions f may be formed between each of the wall portions 112*d*, 122*d*.

Figure 7:
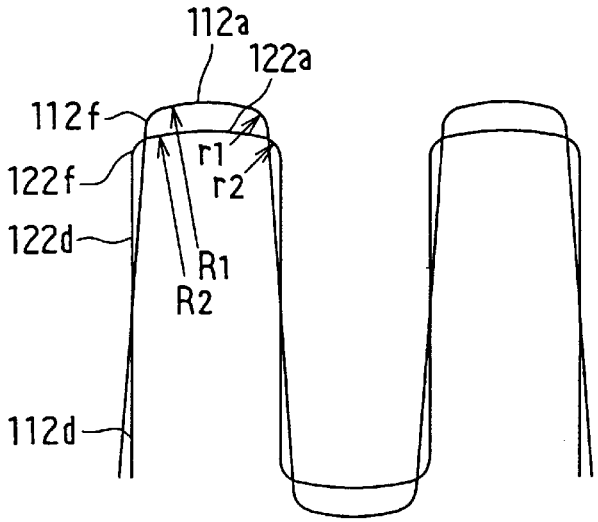
FIG. 7 is a schematic partial front view showing a fin of a double heat exchanger according to a modification of the embodiment.
Figure 8:
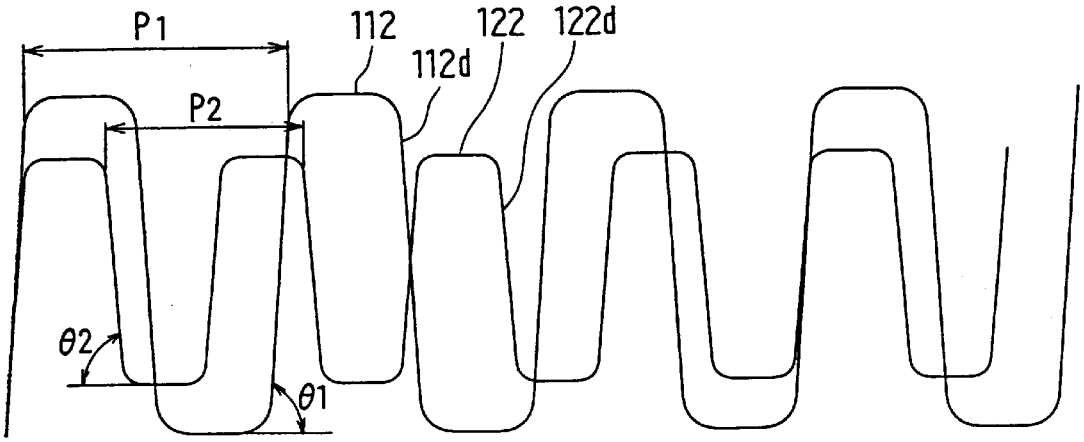
FIG. 8 is a schematic partial front view showing a fin of a double heat exchanger according to another modification of the embodiment.

As shown in FIG. 7, each of the flat portions 112*a*, 122*a* may be curved to have a radius of curvature R1, R2 larger than the radius of curvature r1, r2, respectively. Further, as shown in FIG. 8, when the connection portions f are formed at intervals of several upper folds 112*b*, 122*b*, a fin pitch P1 of the condenser fin 112 between adjacent upper folds 112*b* may be different from a fin pitch P2 of the radiator fin 122 between adjacent upper folds 122*b* between adjacent connection portions f. As a result, the inclination angle θ1 of the condenser fin 112 becomes different from the inclination angle θ2 of the radiator fin 122 between adjacent connection portions f, and the height H1 of the condenser fin 112 becomes different from the height H2 of the radiator fin 122. In this case, each of the condenser fin 112 and the radiator fin 122 may be formed into a corrugated shape having plural rectangular wave folds or sine wave folds.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A heat exchanger through which air passes comprising:

a first heat exchanger having a plurality of first tubes through which a first fluid flows and a first fin disposed between adjacent first tubes to facilitate heat exchange between the first fluid and air, the first fin having a corrugated shape including a plurality of first upper folds, a plurality of first lower folds and a first wall which connects one of the first upper folds and one of the first lower folds next to each other;

a second heat exchanger disposed at a downstream air side of the first heat exchanger, the second heat exchanger having a plurality of second tubes through which a second fluid flows and a second fin disposed between adjacent second tubes to facilitate heat exchange between the second fluid and air, the second tubes extending in substantially parallel with the first tubes, the second fin integrally formed with the first fin to have a corrugated shape having a plurality of second upper folds, a plurality of second lower folds and a second wall which connects one of the second upper folds and one of the second lower folds next to each other; and a connection member which partially connects the first fin and the second fin, wherein an inclination angle of the first wall is different from that of the second wall.

2. The heat exchanger according to claim 1, wherein:

the connection member includes a plurality of connection portions; and the connection portions are disposed at intervals of a predetermined number of the first and second upper folds.

3. The heat exchanger according to claim 1, wherein the first fin and the second fin are disposed away from each other with a predetermined gap therebetween.

4. The heat exchanger according to claim 1, wherein each of the first and second walls respectively has a louver integrally formed with each of the first and second walls to protrude from each of the first and second walls.

5. The heat exchanger according to claim 1, wherein a radius of curvature of each of the first upper folds and the first lower folds is equal to a radius of curvature of each of the second upper folds and the second lower folds.

6. The heat exchanger according to claim 1, wherein a height of the first fin is different from a height of the second fin in a direction perpendicular to a longitudinal direction of the first and second tubes.

7. The heat exchanger according to claim 1, wherein a difference between a height of the first fin and a height of the second fin in a direction perpendicular to a longitudinal direction of the first and second tubes is set to approximately 0.1–1.0 mm.

8. The heat exchanger according to claim 1, wherein:

the first fluid is a refrigerant circulating through a refrigeration cycle for a vehicle air conditioner;

the second fluid is an engine coolant for cooling a vehicle engine; and a height of the first fin is larger than that of the second fin in a direction perpendicular to a longitudinal direction of the first and second tubes.

9. A heat exchanger through which air passes comprising:

a first heat exchanger having a plurality of first tubes through which a first fluid flows and a first fin disposed between adjacent first tubes to facilitate heat exchange between the first fluid and air, the first fin having a corrugated shape including a plurality of first upper folds, a plurality of first lower folds and a first wall which connects one of the first upper folds and one of the first lower folds next to each other, each of the first upper and lower folds having a rectangular wave shape to have a first flat portion extending in substantially parallel with a longitudinal direction of the first tubes;

a second heat exchanger disposed at a downstream air side of the first heat exchanger, the second heat exchanger having a plurality of second tubes through which a second fluid flows and a second fin disposed between adjacent second tubes to facilitate heat exchange between the second fluid and air, the second tubes extending in substantially parallel with the first tubes, the second fin being integrally formed with the first fin to have a corrugated shape including a plurality of second upper folds, a plurality of second lower folds and a second wall which connects one of the second upper folds and one of the second lower folds next to each other, each of the second upper and lower folds having a rectangular wave shape to have a second flat portion extending in substantially parallel with a longitudinal direction of the second tubes; and a connection portion which partially connects the first fin and the second fin, wherein a length of the first flat portion is different from that of the second flat portion in a longitudinal direction of the first and second tubes.

10. The heat exchanger according to claim 9, wherein:

the connection member includes a plurality of connection portions; and the connection portions are disposed at intervals of a predetermined number of the first and second upper folds.

11. The heat exchanger according to claim 9, wherein the first fin and the second fin are disposed away from each other with a predetermined gap therebetween.

12. The heat exchanger according to claim 9, wherein each of the first and second walls respectively has a louver integrally formed with each of the first and second walls to protrude from each of the first and second walls.

13. The heat exchanger according to claim 9, wherein a difference between a length of the first flat portion and a length of the second flat portion in a longitudinal direction of the first and second tubes is set to approximately 0.05–0.5 mm.

14. The heat exchanger according to claim 9, wherein:

the first fluid is a refrigerant circulating through a refrigeration cycle of a vehicle air conditioner;

the second fluid is an engine coolant for cooling a vehicle engine; and a height of the first fin is larger than that of the second fin in a direction perpendicular to a longitudinal direction of the first and second tubes.

* * * * *